US008152481B2

(12) United States Patent
Takahashi et al.

(10) Patent No.: US 8,152,481 B2
(45) Date of Patent: Apr. 10, 2012

(54) PISTON-TYPE COMPRESSOR

(75) Inventors: Tomoyasu Takahashi, Saitama (JP); Keiichi Kanesugi, Saitama (JP)

(73) Assignee: Valeo Thermal Systems Japan Corporation, Saitama (JP)

( * ) Notice: Subject to any disclaimer, the term of this patent is extended or adjusted under 35 U.S.C. 154(b) by 932 days.

(21) Appl. No.: 11/543,228

(22) Filed: Oct. 5, 2006

(65) Prior Publication Data

US 2007/0081905 A1 Apr. 12, 2007

(30) Foreign Application Priority Data

Oct. 6, 2005 (JP) ..... 2005-293526
Aug. 28, 2006 (JP) ..... 2006-230749

(51) Int. Cl.
*F04B 1/12* (2006.01)
*F01M 1/00* (2006.01)

(52) U.S. Cl. ..... 417/269; 184/6.17

(58) Field of Classification Search ..... 417/269, 417/222.1, 222.2; 92/12.2; 184/6.17
See application file for complete search history.

(56) References Cited

U.S. PATENT DOCUMENTS

| | | | | |
|---|---|---|---|---|
| 4,586,876 | A * | 5/1986 | Kato et al. | 417/269 |
| 4,737,079 | A * | 4/1988 | Kurosawa et al. | 417/222.2 |
| 6,019,027 | A * | 2/2000 | Furuya et al. | 92/71 |
| 6,206,648 | B1 * | 3/2001 | Kimura et al. | 417/222.2 |
| 6,520,748 | B2 * | 2/2003 | Yokomachi et al. | 417/222.2 |
| 6,558,133 | B2 * | 5/2003 | Fukanuma et al. | 417/222.2 |
| 6,786,703 | B2 * | 9/2004 | Breindel et al. | 417/222.2 |
| 7,530,797 | B2 * | 5/2009 | Ito et al. | 417/222.2 |
| 2003/0035732 | A1 * | 2/2003 | Yokomachi et al. | 417/222.2 |
| 2004/0005223 | A1 * | 1/2004 | Kawachi et al. | 417/222.1 |
| 2004/0062660 | A1 * | 4/2004 | Kazahaya et al. | 417/222.1 |
| 2004/0197202 | A1 * | 10/2004 | Saiki et al. | 417/269 |

FOREIGN PATENT DOCUMENTS

| | | | |
|---|---|---|---|
| DE | 196 10 437 | A1 | 10/1996 |
| EP | 0 881 385 | A2 | 12/1998 |
| EP | 0 926 346 | A2 | 6/1999 |
| EP | 1 160 449 | A1 | 12/2001 |
| JP | 2002-310067 | A | 10/2002 |

* cited by examiner

*Primary Examiner* — Charles Freay
(74) *Attorney, Agent, or Firm* — Rader, Fishman & Grauer PLLC

(57) ABSTRACT

This invention is to provide a piston-type compressor that assures optimal lubrication by supplying oil in plentiful quantity to a sliding portion in a cylinder block having cylinders formed therein, through which pistons slide reciprocally. A crankcase is defined by a cylinder block 1 having formed therein a plurality of cylinders 17 through which pistons slide, and a housing mounted at the cylinder block 1, and as a shaft passing through the crankcase rotates, a swashplate disposed inside the crankcase is made to rotate, thereby engaging the pistons to reciprocally slide through the cylinders. At the cylinder block 1, an inbound oil guide passage 35 having one end thereof made to open over an area at the end surface of the cylinder block facing the crankcase between adjacent cylinders 17 and another end thereof connecting to a sliding portion inside the cylinder block.

11 Claims, 8 Drawing Sheets

(a)

(b)

(a)

(b)

(a)

(b)

PISTON-TYPE COMPRESSOR

CROSS-REFERENCE TO RELATED APPLICATIONS

This application is based upon and claims the benefit of priority from the prior Japanese Patent Application No. 2005-293526 filed on Oct. 6, 2005 and the prior Japanese Patent Application No. 2006-230749 filed on Aug. 28, 2006 the entire contents of which are incorporated herein by reference.

TECHNICAL FIELD

The present invention relates to a piston-type compressor adopting a structure in which oil inside a crankcase formed by a cylinder block and a housing mounted at the cylinder block is supplied to sliding portions inside the cylinder block.

BACKGROUND ART

It is crucial that an optimal oil supply system be achieved to allow oil to be supplied to sliding portions in order to prevent seizure from occurring at the sliding portions in a piston-type compressor having a crankcase defined by a cylinder block with a plurality of cylinders in which pistons slide formed therein and a housing mounted at the cylinder block, at least one end of a shaft passing through the crankcase rotatably supported at the cylinder block via a bearing and the pistons made to reciprocally slide inside the cylinders by rotating a swashplate disposed inside the crankcase as the shaft rotates.

In particular, when a radial bearing used to support the shaft is constituted with a plane bearing (sliding bearing) in order to minimize the production costs, the bearing and the shaft are bound to slide over a significant area. Thus, seizure will occur readily unless lubricating oil is supplied in sufficient quantity. Accordingly, in a structure proposed in the related art, an isolation space defined by the sliding bearing and a shaft sealing member (a seal member constituted with a lip seal) and made to communicate with the crankcase via a lubricating oil passage present at a front housing, is also made to communicate with the crankcase via a gap between the shaft and the sliding bearing, the lubricating oil in the crankcase is guided into the isolation space via one of the communicating paths and the lubricating oil inside the isolation space is guided back into the crankcase via the other path (see Japanese Unexamined Patent Publication No. 2002-310067)

DISCLOSURE OF THE INVENTION

Problems to be Solved by the Invention

While the structure of the piston-type compressor described above allows the oil to be supplied in large quantity to the portion of the bearing on the front housing side, it does not include any special structural feature that will assure effective oil supply to sliding portions within the cylinder block such as the shaft bearing portion within the cylinder block, which are subject to significant force as the pistons reciprocally slide through the cylinders and thus require ample lubrication. For this reason, if a plane bearing is used as the shaft bearing in the piston-type compressor, seizure may occur due to insufficient oil supply.

A primary object of the present invention, which has been completed by addressing the problem discussed above, is to provide a piston-type compressor that assures good lubrication at the sliding portions in the cylinder block having formed therein cylinders through which the pistons slide reciprocally by supplying oil to the sliding portions in sufficient quantity.

Means for Solving the Problems

The object described above is achieved in the present invention by providing a piston-type compressor having a crankcase defined therein by a cylinder block with a plurality of cylinders through which pistons slide formed therein and a housing mounted at the cylinder block, with at least one end of a shaft passing through the crankcase rotatably supported at the cylinder block via a bearing or by allowing the one end of the shaft to directly slide against the cylinder block and a swashplate disposed in the crankcase made to rotate as the shaft rotates thereby causing the pistons to reciprocally slide through the cylinders, characterized in that an inbound oil guide passage with one end thereof opening between cylinders set next to each other at an end surface of the cylinder block facing the crankcase and another end thereof communicating with a sliding portion inside the cylinder block, is formed at the cylinder block.

Accordingly, the oil picked up via the swashplate and the like inside the crankcase is delivered to the end surface of the cylinder block facing the crankcase and the oil is guided downward through the area between the cylinders as the oil travels down through the end surface due to gravity. In particular, when the pistons move so as to drive into the crankcase beyond the open ends of the cylinders, the oil about to descend via the circumferential surfaces of the adjacent pistons tends to be collected readily in the space between the cylinders. Since one end of the inbound oil guide passage opens at the area between the cylinders set next to each other at the end surface of the cylinder block facing the crankcase, the oil about to move down between the cylinders through the end surface can be readily guided into the inbound oil guide passage, which makes it possible to supply the oil in large quantity to the sliding portions inside the cylinder block.

As described above, the oil delivered to the end surface of the cylinder block is collected into the area between the cylinders and moves downward. For this reason, it is desirable to set the one end of the inbound oil guide passage so as to open at the area separating the cylinders over the smallest distance, where the oil is collected most densely.

In addition, the one end of the inbound oil guide passage may be made to open over an area on the lower side relative to the line connecting the centers of adjacent cylinders so as to draw in the oil having been collected.

In addition, it is desirable that the inbound oil guide passage, into which oil descending through the end surface is drawn to be delivered to the sliding portion by taking advantage of gravity, be formed at a position higher than the sliding portion.

If the sliding portion within the cylinder block in the structure described above is a radial bearing rotatably supporting the shaft and constituted with a plane bearing, the other end of the inbound oil guide passage should be set so as to face a portion communicating with the sliding surface of the plane bearing or to face a hole communicating with the sliding surface formed at the plane bearing.

If the bearing also includes a thrust bearing, the inbound oil guide passage may be set so as to face the thrust bearing. More specifically, the other end of the inbound oil guide passage may be made to open between the plane bearing and the thrust bearing.

Furthermore, the inbound oil guide passage may be formed so as to pass through a closed space formed in the cylinder block. In this case, the closed space can be used as part of the passage.

Moreover, if there is any likelihood of the oil having been delivered to the portions that need to be lubricated via the inbound oil guide passage becoming stagnant to cause an increase in the temperature, an outbound oil guide passage through which the oil is let out may be formed at a side of or under the sliding portion.

In order to ensure that the oil is drawn into the inbound oil guide passage efficiently in the structure described above, a projection to function as an oil deflector may be disposed at the end surface of the cylinder block facing the crankcase, over the lower side of the opening at the one end of the inbound oil guide passage.

EFFECT OF THE INVENTION

As explained above, the piston-type compressor according to the present invention includes an inbound oil guide passage formed at the cylinder block with one end thereof made to open over the area between cylinders set next to each other at the end surface facing the crankcase and the other end thereof communicating with a sliding portion inside the cylinder block. As a result, oil can be supplied to the sliding portion inside the cylinder block in ample quantity, and even when the shaft bearing is constituted with a plane bearing, good lubrication is assured.

EXPLANATION OF REFERENCE NUMERALS

Figure 1:
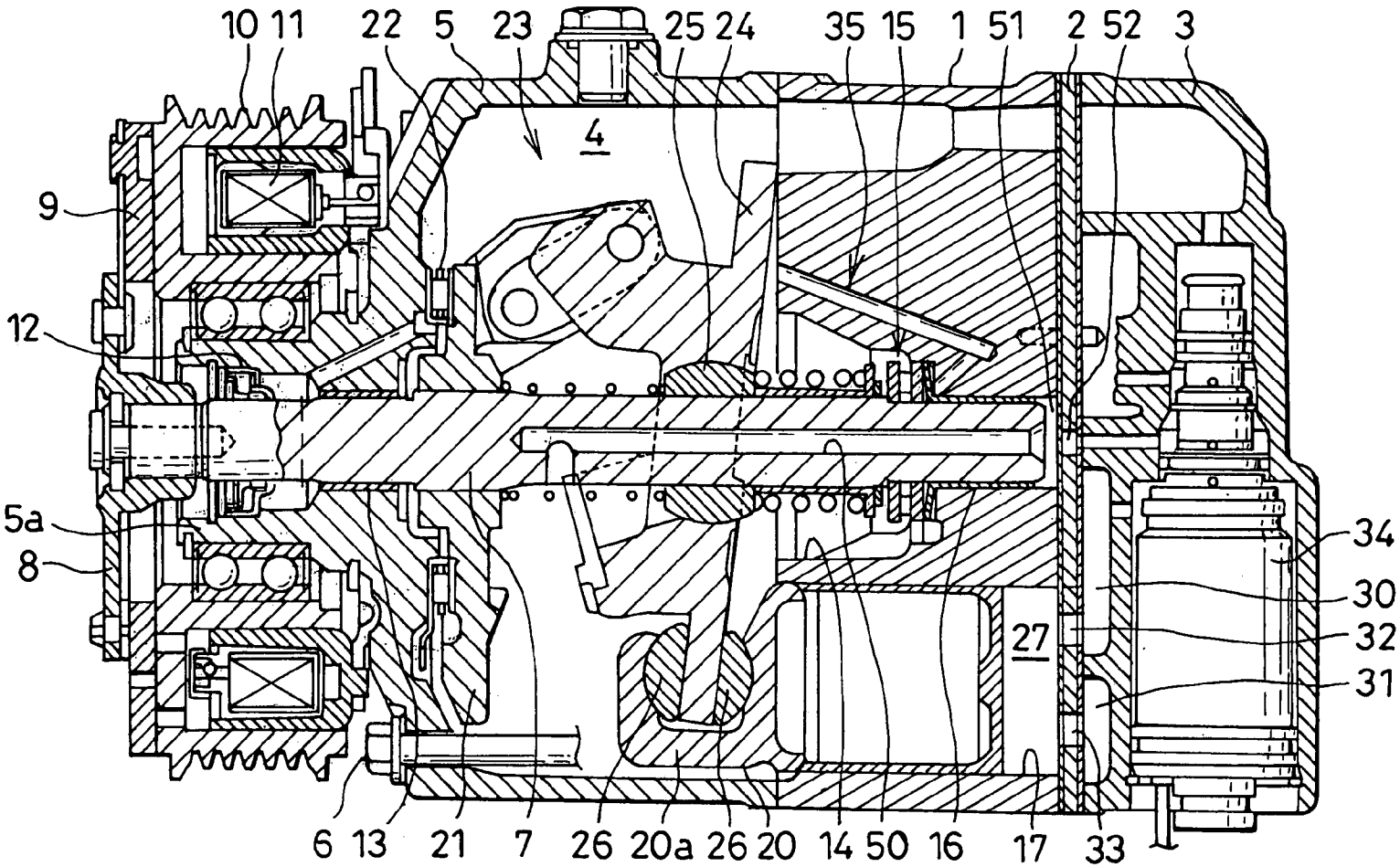
FIG. 1 is a sectional view of a structural example that may be adopted in the compressor according to the present invention.

1 cylinder block
4 crankcase
5 front housing
7 shaft
15 thrust bearing
16 plane bearing
17 cylinder
20 piston
24 swashplate
35 inbound oil guide passage
40 closed space
41 oil deflecting projection
45 outbound oil guide passage

BEST MODE FOR CARRYING OUT THE INVENTION

The following is an explanation of the best mode for carrying out the invention, given in reference to the attached drawings.

The compressor shown in FIG. 1 comprises a cylinder block 1, a rear housing 3 mounted on the rear side of the cylinder block 1 via a valve plate 2 and a front housing 5 mounted so as to cover the cylinder block 1 and defining a crankcase 4 on the front side of the cylinder block 1. The front housing 5, the valve plate 2 and the rear housing 3 are fastened together via a fastening bolt 6 along the axial direction.

A shaft 7 with one end thereof projecting out beyond the front housing 5 is housed inside the crankcase 4 formed by the front housing 5 and the cylinder block 1. A clutch plate 9 is fixed onto the portion of the shaft 7, projecting out beyond the front housing 5, via a relay member 8 mounted along the axial direction. A drive pulley 10, which is rotatably fitted from the outside, is disposed at a boss portion 5*a* of the front housing 5 so as to face opposite the clutch plate 9 and as power is supplied to an exciting coil 11 embedded in the drive pulley 10, the clutch plate 9 becomes attracted to the drive pulley 10 and the rotational motive force applied to the drive pulley 10 is thus transmitted to the shaft 7.

In addition, the gap between one end of the shaft 7 and the front housing 5 is sealed with a high level of airtightness via a seal member 12 disposed between the one end and the front housing 5. The one end of the shaft 7 is rotatably supported at a sliding bearing (plane bearing) 13 constituting a radial bearing. The other end of the shaft 7 is rotatably supported via a thrust bearing 15 housed inside a housing hole 14 formed at a substantial center of the cylinder block 1 and a sliding bearing (plane bearing) 16 constituting a radial bearing and present adjacent to the thrust bearing 15 on the rear side. The sliding bearings (plain bearings) 12 and 16 are metal cylindrical members constituted of aluminum (Al) or iron (Fe) containing a solid lubricant or copper (Cu). The material that may be used to constitute the metal cylindrical members is of the known art.

Figure 2:
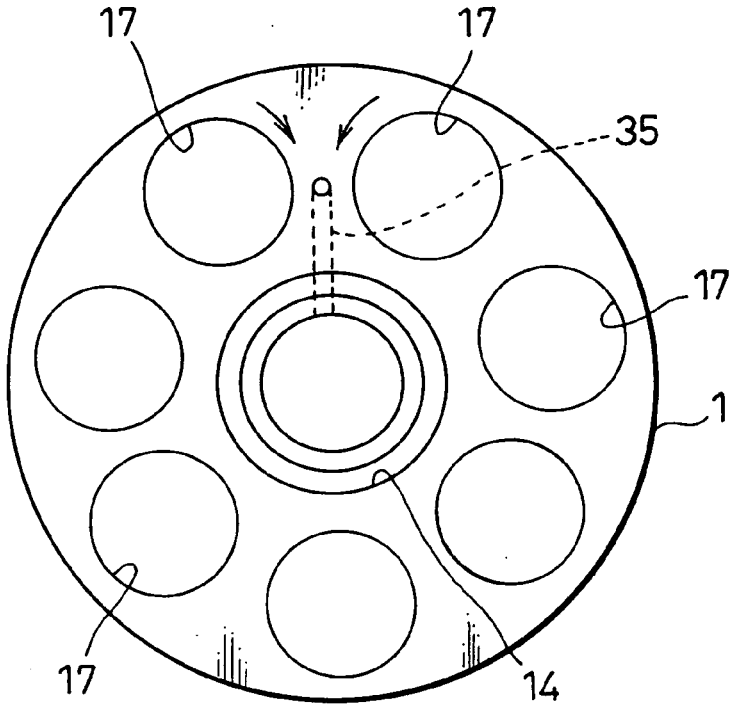
FIG. 2 shows the end surface of the cylinder block facing the crankcase, with one end of the inbound oil guide passage made to open over the area where the distance between the cylinders is at its smallest.

As shown in FIG. 2, the housing hole 14 mentioned earlier, in which the sliding bearing 16 or the like is housed, and a plurality of cylinders 17 set over equal intervals on the circumference of a circle centering around the housing hole 14 are formed at the cylinder block 1. A single-ended piston 20 is inserted at each cylinder so as to be allowed to slide reciprocally.

Inside the crankcase 4, a thrust flange 21 is fixed onto the shaft 7 so as to rotate as one with the shaft 7. The thrust flange 21 is rotatably supported via a thrust bearing 22 at the inner wall surface of the front housing 5 formed to range substantially perpendicular to the shaft 7. A swashplate 24 is connected to the thrust flange 21 via a link member 23.

The swashplate 24 is tiltably held via a hinge ball 25 disposed on the shaft 7 and rotates as one with the thrust flange 21 in synchronization with the rotation of the thrust flange 21. The thrust flange 21 and the swashplate 24 constitute a motive force transmission mechanism that rotates in synchronization with the rotation of the shaft 7. An engaging portion 20*a* of each single-ended piston 20 is held at the circumferential edge of the swashplate 24 via a pair of shoes 26 disposed to the front and the rear.

Thus, as the shaft 7 rotates, the swashplate 24 also rotates, and this rotating motion of the swashplate 24 is converted to the reciprocal linear motion of the single-ended piston 20 via the shoes 26, thereby altering the volumetric capacity of a compression space 27 defined within the cylinder door 17 by the piston 20 and the valve plate 2.

At the rear housing 3, an intake chamber 30 and an outlet chamber 31 formed further outward relative to the intake chamber 30 are defined. At the valve plate 2, an intake hole 32 that communicates between the intake chamber 30 and the compression space 27 via an intake valve (not shown) and an outlet hole 33 that communicates between the outlet chamber 31 and the compression space 27 via an outlet valve (not shown) are formed.

In addition, a pressure control valve 34, through which the state of communication between the outlet chamber 31 and the crankcase 4 and the state of communication between the crankcase 4 and the intake chamber 30 are adjusted, is mounted at the rear housing 3, and the pressure in the crankcase 4 is controlled with the pressure control valve 34 so as to adjust the piston stroke, i.e., the output capacity.

Figure 3:
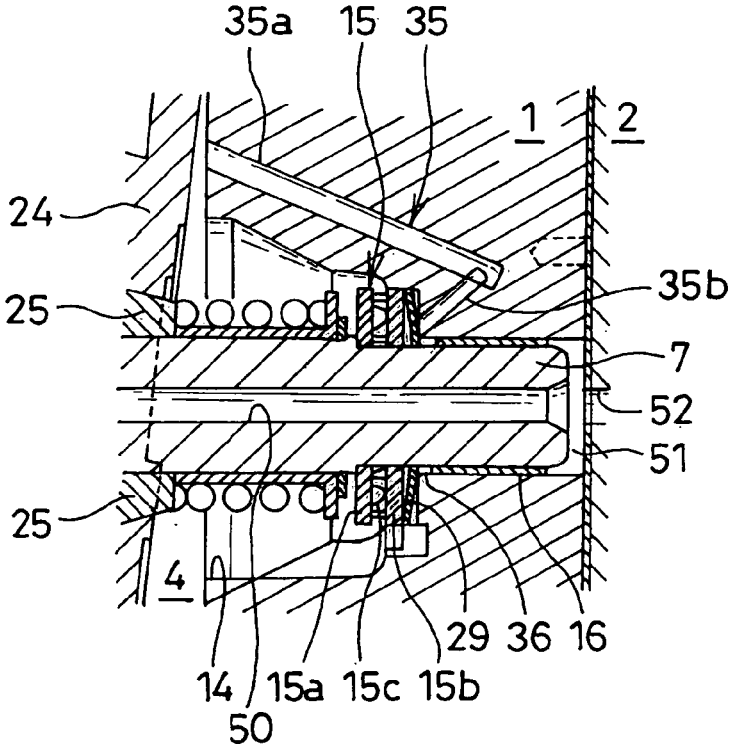
FIG. 3 is an enlarged sectional view of the area around the plane bearing and the inbound oil guide passage within the cylinder block in FIG. 1, with the inbound oil guide passage connecting to the front side of the sliding portion at the plane bearing.

In the cylinder block 1 in the structure described above, an inbound oil guide passage 35 with one end thereof opening into the crankcase 4 and another end thereof communicating with a sliding portion of the plane bearing 16 is formed. More specifically, as shown in FIGS. 2 and 3, one end of the inbound oil guide passage 35 is made to open at the end surface of the cylinder block 1 facing the crankcase 4, over the area between two adjacent cylinders 17 present above the plane bearing 16. In this particular example, one end of the inbound oil guide passage 35 is made to open over the area separating the cylinders over the smallest distance. The inbound oil guide passage 35 in the example includes a first passage 35*a* formed so as to extend diagonally downward toward the rear housing 3 from the end surface of the cylinder block 1 facing the crankcase 4 and a second passage 35*b* formed so as to extend diagonally upward toward the rear housing 3 from the inside of the housing hole 14 and communicate with the first passage 35*a*. The thrust bearing 15 mentioned earlier is disposed on the front side of a washer 29 that applies a load to the shaft 7 along the axial direction. The thrust bearing 15 is constituted with a pair of holding plates 15*a* and 15*b* and a roller 15*c* disposed between the holding plates. One end of the second passage 35*b* is connected to the first passage 35*a* in the vicinity of the terminal thereof, whereas the other end of the second passage communicates with a space 36 formed between the plane bearing 16 and the washer 29.

It is to be noted that an air bleeding passage connecting to a low-pressure space (intake chamber 30) via a passing hole 50 formed at the shaft 7, a space 51 formed within the cylinder block 1 between the shaft 7 and the valve plate 2, a passing hole 52 formed at the valve plate 2 and the like is formed, and a space 36 formed between the plane bearing 16 and the washer 29 communicates with the space 51 formed between the shaft 7 and the valve plate 2 via a specific clearance formed between the plane bearing 16 in the shaft 7. In addition, a clearance larger than the plane bearing 16 is formed at the thrust bearing 15.

As the clutch plate 9 becomes attracted to the drive pulley 10 and the rotating motive force applied to the drive pulley 10 causes the shaft 7 to rotate in the structure described above, the swashplate 24 also rotates and the pistons 20 start sliding reciprocally through the cylinders 17. In addition, the oil having been collected at the bottom within the crankcase 4 is picked up as the swashplate 24 and the like move, becomes settled on the inner surfaces defining the crankcase 4, which include the end surface of the cylinder block 1 and subsequently travels downward through the surfaces where it has settled due to gravity. While the pistons 20 each slide out beyond the end surface of the cylinder block 10 into the crankcase 4 during this process, the oil having become settled over the upper area of the end surface of the cylinder block 1 is guided to the circumferential surfaces of the pistons 20 and travels downward as it is collected between the cylinders. When the pistons 20 do not slide out beyond the end surface of the cylinder block 1 into the crankcase 3, too, the oil is collected between the cylinders 17 as it travels via the end surface of the cylinder block 1 and moves downward. The oil thus collected then enters the inbound oil guide passage 35 through the opening between the cylinders and is guided through the passage into the space 36 formed between the washer 29 and the plane bearing 16. Since the space 36 communicates with the air bleeding passage via the specific clearance between the plane bearing 16 and the shaft 7, the oil guided to the space 36 is then guided into the clearance between the plane bearing 16 and the shaft and is returned to the crankcase 4 via the clearance at the thrust bearing 15.

During this process, the clearance at the thrust bearing ensures that the oil cannot return to the crankcase without first lubricating the plane bearing 16 and, at the same time, since the clearance at the plane bearing is small enough, a large quantity of oil having been supplied through the inbound oil guide passage is not allowed to exit the crankcase via the air bleeding passage. As a result, the ample quantity of oil collected between the cylinders and supplied via the inbound oil guide passage 35 is then delivered into the clearance present between the plane bearing 16 and the shaft 7 while the oil flow out of the crankcase is regulated. Consequently, even when the bearing for the shaft 7 within the cylinder block 1 is constituted with the plane bearing 16 as in this structural example, optimal lubrication is assured.

Figure 4:
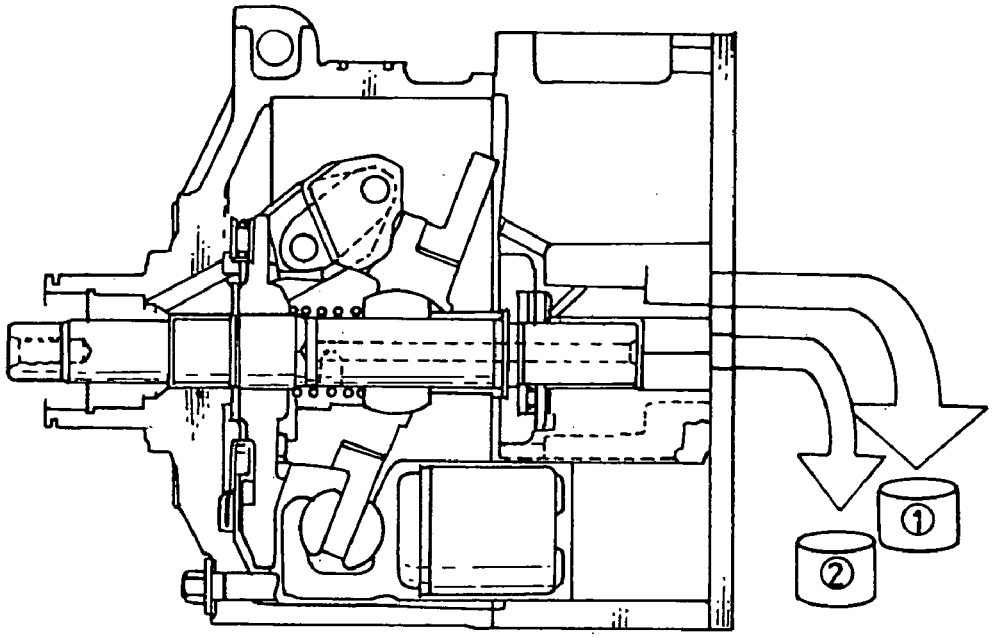
FIG. 4(*a*) schematically illustrates a test device used to run tests on a given compressor and FIG. 4(*b*) is a graph presenting the results of the measurement of the quantities of oil flowing in the compressor, i.e., the quantity of oil passing through the inbound oil guide passage and the quantity of oil passing through the plane bearing, relative to the compressor rotation rate.
Figure 4:
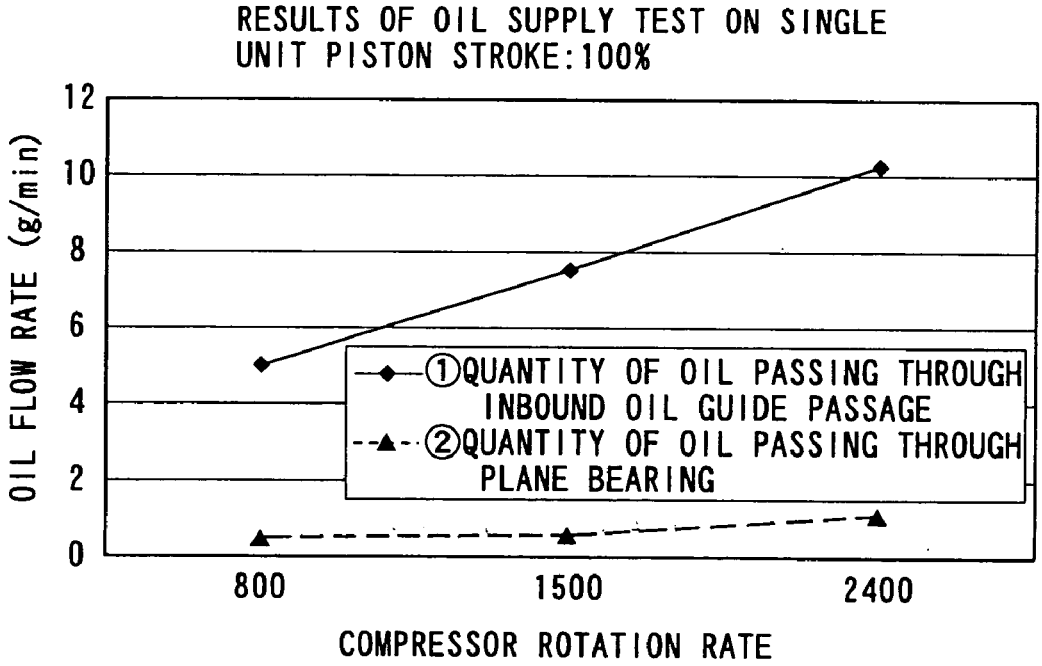

The inventor of the present invention et al. investigated how much oil was actually supplied to the area around the bearing by fixing the piston stroke in a variable displacement swashplate compressor at the maximum setting (setting the piston stroke to 100%), rotating the compressor without connecting it to a refrigerating circuit and measuring the quantities of oil supplied to various parts of the compressor (see FIG. 4(*a*)).

In the test marked 1 (hereafter referred to as the test 1) in FIG. 4(*a*), a tube was connected to a closed space 40 communicating with the inbound oil guide passage 35 and the quantity of oil flowing out of the compressor was measured. This measured quantity is equivalent to the quantity of oil supplied to the space 36 present between the washer 29 and the plane bearing 16 during operation of the compressor.

In the test marked 2 (hereafter referred to as the test 2) in FIG. 4(*a*), a tube was connected to a closed space 51 formed inside the cylinder block 1 between the shaft 7 and the valve plate 2 and the quantity of oil flowing out of the compressor was measured. This measured quantity is equivalent to the quantity of oil passing through the clearance between the plane bearing 29 and the shaft 7 during operation of the compressor.

FIG. 4(*b*) presents the results of the tests. As the test results indicate, a sufficient quantity of oil is supplied through the inbound oil guide passage 35 and consequently, the plane bearing is lubricated with a high level of reliability.

In addition, (intermittent) high-speed endurance tests were conducted on variable displacement compressors each equipped with a plane bearing, one having the inbound oil guide passage 35 formed therein and the other without the inbound oil guide passage 35. In the compressor that did not include the inbound oil guide passage 35, the rear-side bearing became worn to an extent of 113~126 μm. Judging from the state of the bearing surface observed after the endurance test, no sliding problems, e.g., seizure, had occurred and the rear-side bearing was assumed to have become worn due to insufficient supply of lubricating oil.

In contrast, hardly any ware (0~6 μm) was observed after the endurance tests conducted on nine compressors each having formed therein the inbound oil guide passage 35 according to the present invention indicating that the presence of the inbound oil guide passage 35 markedly reduced the extent of wear.

Figure 5:
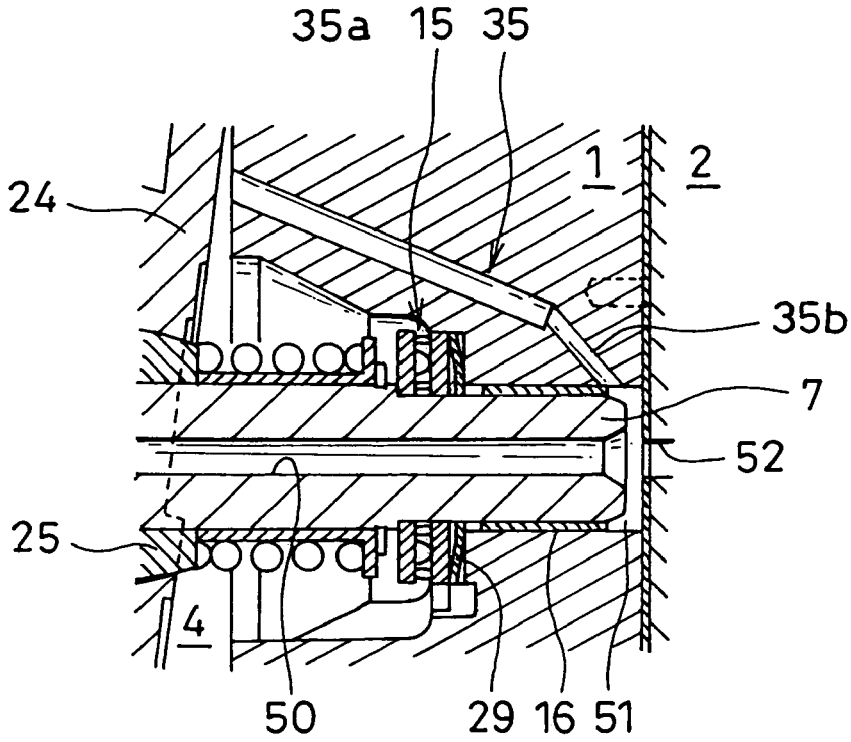
FIG. 5 is an enlarged sectional view of another structural example that may be adopted in the area around the plane bearing and the inbound oil guide passage in the cylinder block, with the inbound oil guide passage connecting to the rear side of the sliding portion at the plane bearing.

It is to be noted that while the inbound oil guide passage 35 is connected to the front side of the plane bearing 16, i.e., to the space 36 present between the plane bearing 16 and the washer 29, in the structure described above, the second passage 35*b* may be formed so as to extend diagonally downward toward the rear housing 3 from the first passage to communicate with the space 51 formed at the shaft front end, as shown in FIG. 5. In this case, the oil is guided from the rear side of the plane bearing 16.

While part of the oil supplied to the space 51 directly flows out toward the intake chamber through the passing hole in this structure, some of the oil enters the clearance at the bearing to lubricate the bearing. Since the first passage and the second passage intersect each other with an obtuse angle, this alternative structure achieves an advantage in that burrs are not readily formed at the intersecting area.

As a further alternative, a hole 38 may be formed at the plane bearing 16 to communicate with the sliding surface over which the plane bearing 16 slides against the shaft 7 and the second passage 35*b* may be formed so as to communicate between the first passage 35*a* and the hole 38 at the plane bearing 16. The alignment of the hole 38 and the second passage 35*b* may be facilitated by setting the diameter at the opening of the second passage 35*b* facing the plane bearing 16 to a large value.

In this structure, the oil guided through the inbound oil guide passage 35 is supplied into the clearance between the plane bearing 16 and the shaft 7 via the hole at the plane bearing 16, which ensures that an ample quantity of oil can be supplied to the area between the plane bearing 16 and the shaft 7 to achieve good lubrication.

Figure 6:
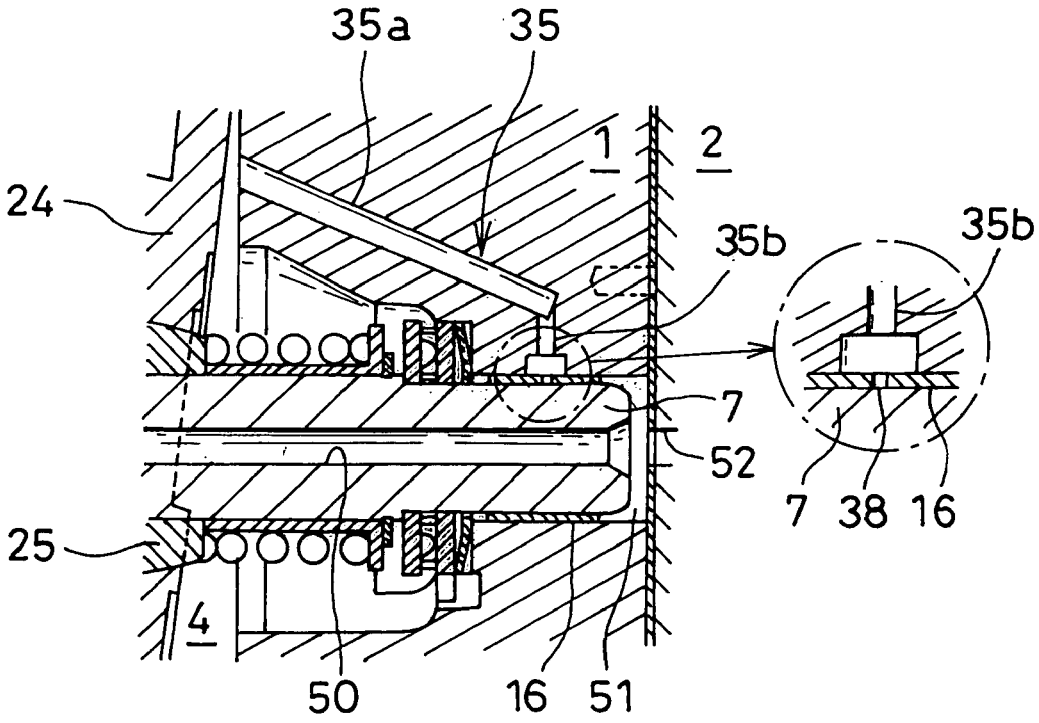
FIG. 6 is an enlarged sectional view of yet another structural example that may be adopted in the area around the plane bearing and the inbound oil guide passage in the cylinder block, with the inbound oil guide passage connecting to a hole formed at the plane bearing.
Figure 7:
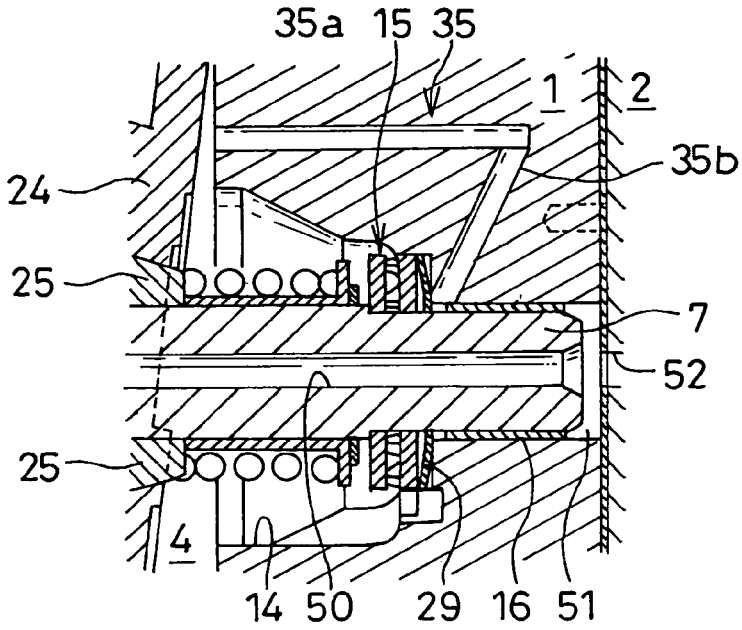
FIG. 7 is an enlarged sectional view of a further structural example that may be adopted in the area around the plane bearing and the inbound oil guide passage in the cylinder block, with a passage constituting part of the inbound oil guide passage and extending from the crankcase formed so as to be substantially level.

It is to be noted that when the first passage 35*a* extends diagonally, as shown in FIG. 3, 5 or 6, the movement of the oil through the first passage is gravity-assisted. However, the first passage, 35*a* may be formed so as to extend substantially level, as shown in FIG. 7. It has been confirmed that the oil can be supplied in sufficient quantity to the sliding portion within the cylinder block through such a first passage.

Figure 8:
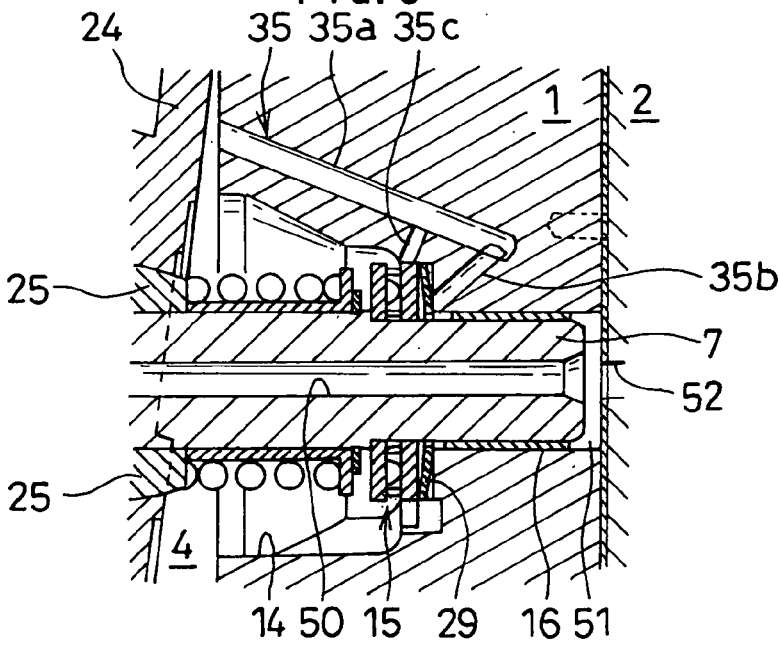
FIG. 8 is an enlarged sectional view of a still further structural example that may be adopted in the area around the plane bearing and the inbound oil guide passage in the cylinder block, with the inbound oil guide passage connecting to the thrust bearing.
Figure 8:
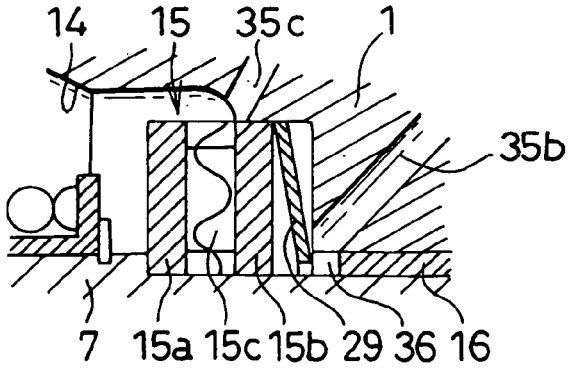

In addition, while the oil inside the crankcase 4 is supplied via the inbound oil guide passage 35 to the sliding portion of the plane bearing 16 disposed inside the cylinder block 1 in the structure described above, the present invention may also be adopted when supplying oil to another sliding portion within the cylinder block 1. For instance, as shown in FIG. 8, the thrust bearing 15 disposed on the front side of the plane bearing 16 may be constituted with a pair of holding plate 15*a* and 15*b* and a roller 15*c* disposed between the holding plates, as explained earlier, the front-side holding plate 15*a* may be fixed onto the shaft 7 and the rear-side holding plate 15*b* may be fixed onto the cylinder block 1, as shown in FIG. 8. In such a case, the oil may be guided through the opening at a third passage 35*c* branching from the inbound oil guide passage 35 over the area between the rear-side holding plate 15*b*, which does not rotate (to which no centrifugal force is applied) and the roller 15*c*.

The structure described above, in which the oil in the crankcase is supplied via the inbound oil guide passage 35 to the sliding area where the plane bearing 16 and the shaft 7 slide against each other and the oil is also supplied to the thrust bearing 15, assures good lubrication.

Figure 9:
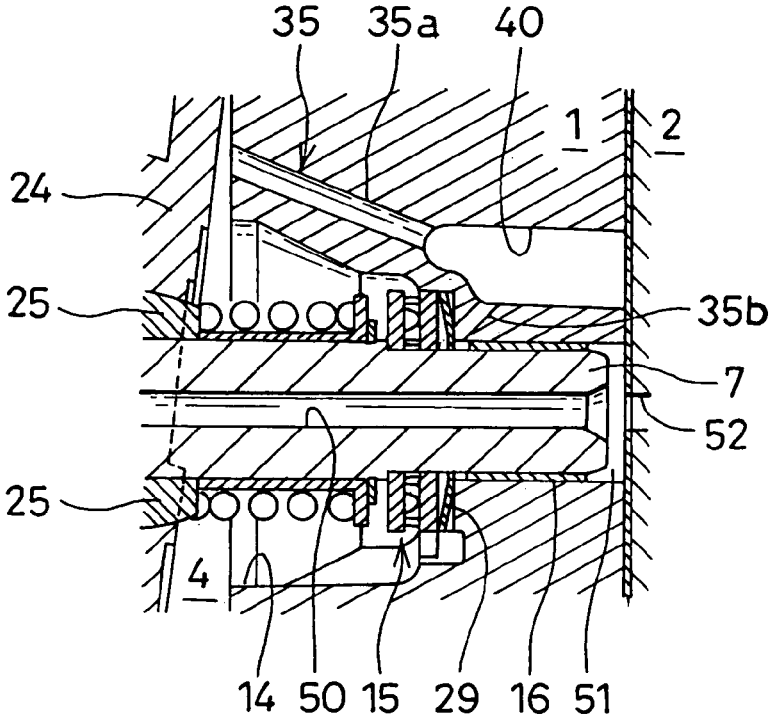
FIG. 9 is an enlarged sectional view of another structural example that may be adopted in the area around the plane bearing and the inbound oil guide passage in the cylinder block, with the inbound oil guide passage passing through a closed space formed at the cylinder block.

Furthermore, a plurality of inbound oil guide passages 35 may be formed between the cylinders or another inbound oil guide passage may be formed between two other cylinders. Also, as shown in FIG. 9, if the cylinder block 1 is partially hollow to constitute a closed space 40 blocked off by the valve plate or the like, the first passage 35*a* may be formed so as to communicate between the crankcase 4 and the closed space 40, the second passage 35*b* may be formed so as to extend from the closed space 40 to the sliding portion of the plane bearing 16 and the closed space 40 may be used as part of the inbound oil guide passage 35.

In this structure, the oil guided into the inbound oil guide passage 35 is temporarily held in the closed space 40 and thus, the oil can be constantly supplied to the sliding portion within the cylinder block.

Figure 10:
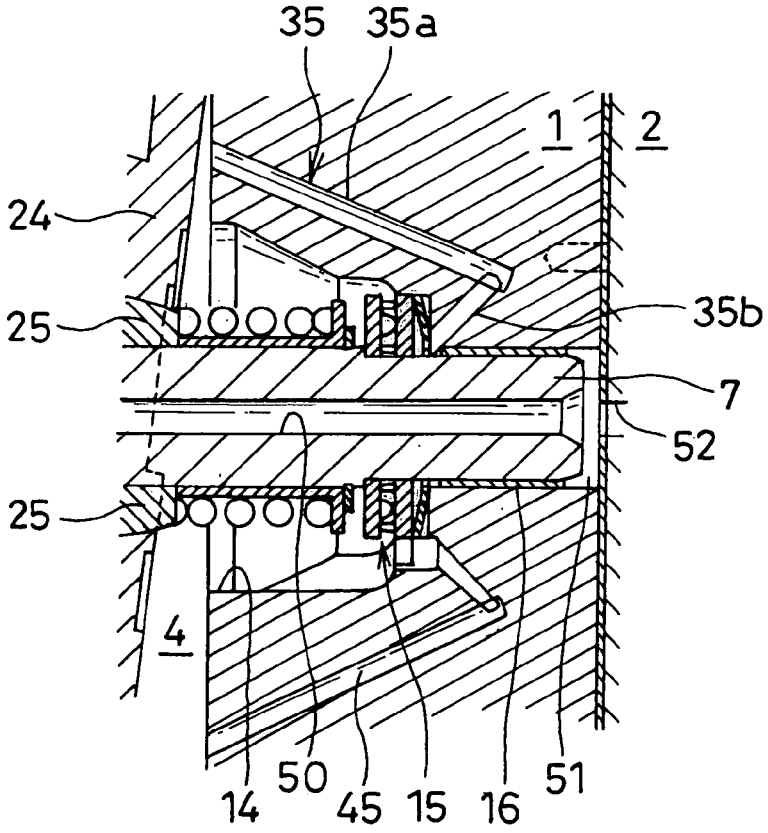
FIG. 10 is an enlarged sectional view of yet another structural example that may be adopted in the area around the plane bearing and the inbound oil guide passage in cylinder block, with an outbound oil guide passage formed in addition to the inbound oil guide passage.

The structural examples explained above all include a passage through which oil is supplied from the crankcase 4 to a sliding portion within the cylinder block 1. While the diameter of the inbound oil guide passage 35 is set so as to ensure that the quantity of oil used at the sliding portion (the quantity of oil traveling through the clearance at the sliding portion) is less than the quantity of oil taken in via the inbound oil guide passage 35, an outbound oil guide passage 45 through which the oil is made to move back into the crankcase 4 from a side or from an area below the sliding portion (the plane bearing 16) may be formed if the oil stagnate on the upstream side of the plane bearing 16 to result in an increase in the oil temperature or accumulation of oil sludge. FIG. 10 shows an example of an outbound oil guide passage that may be formed under such circumstances. The outbound oil guide passage 45, assuming a shape symmetrical to that of the inbound oil guide passage 35 formed above the plane bearing, is formed below the plane bearing 16. It is desirable to set the diameter of the opening at the outbound oil guide passage 45 to a value smaller than that of the diameter at the inbound oil guide passage. The presence of the outbound oil guide passage prevents a temperature rise due to oil stagnation over the area facing the sliding portion and also prevents accumulation of oil sludge.

Figure 11:
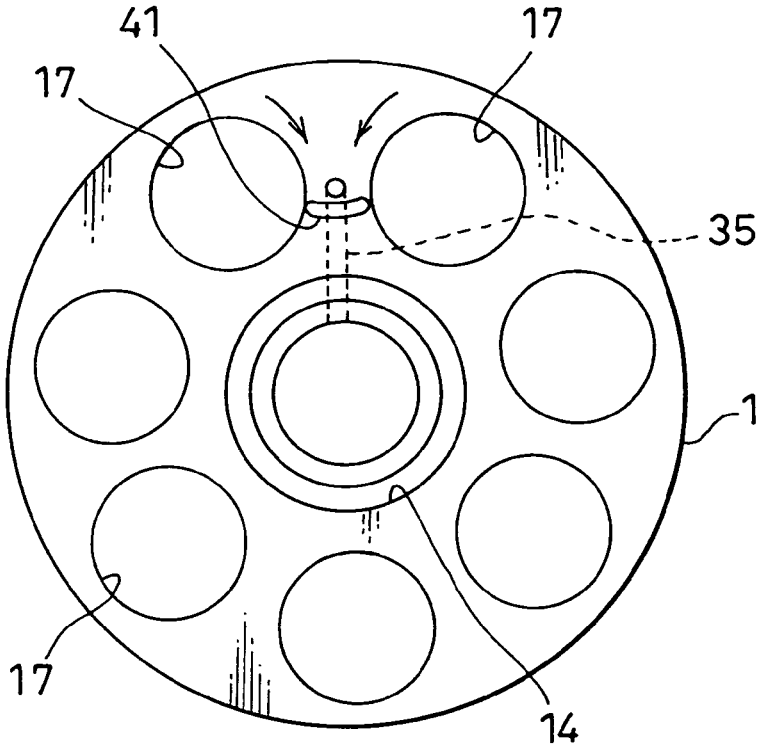
FIG. 11 shows a structural example that includes an oil deflecting projection formed at the intake opening of the inbound oil guide passage formed at the cylinder block, with (a) showing the end surface of the cylinder block facing the crankcase and (b) presenting a sectional view of part of the compressor including the area of the cylinder block over which the inbound oil guide passage is formed.
Figure 11:
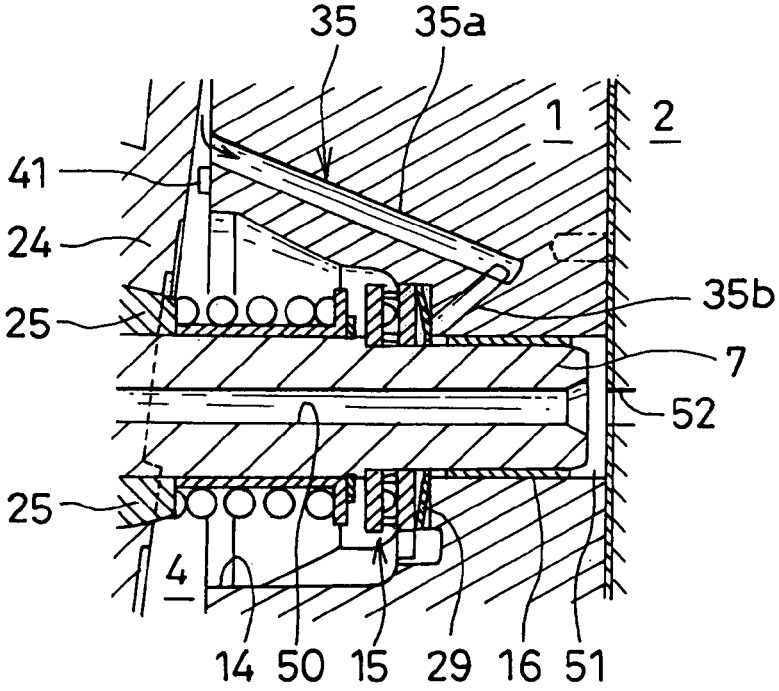

In addition, in order to further facilitate the flow of oil in the crankcase into the inbound oil guide passage 35 in the structure described above, an oil deflecting projection 41 projecting into the crankcase 4 from the lower portion of the opening at the inbound oil guide passage 35 may be formed at the end surface of the cylinder block 1 facing the crankcase, as shown in FIG. 11. This structure further assures a plentiful oil supply since the oil flowing down from the upper side of the end surface of the cylinder block to travel downward and collect between the cylinders is readily guided into the inbound oil guide passage via the oil deflecting projection 41.

Figure 12:
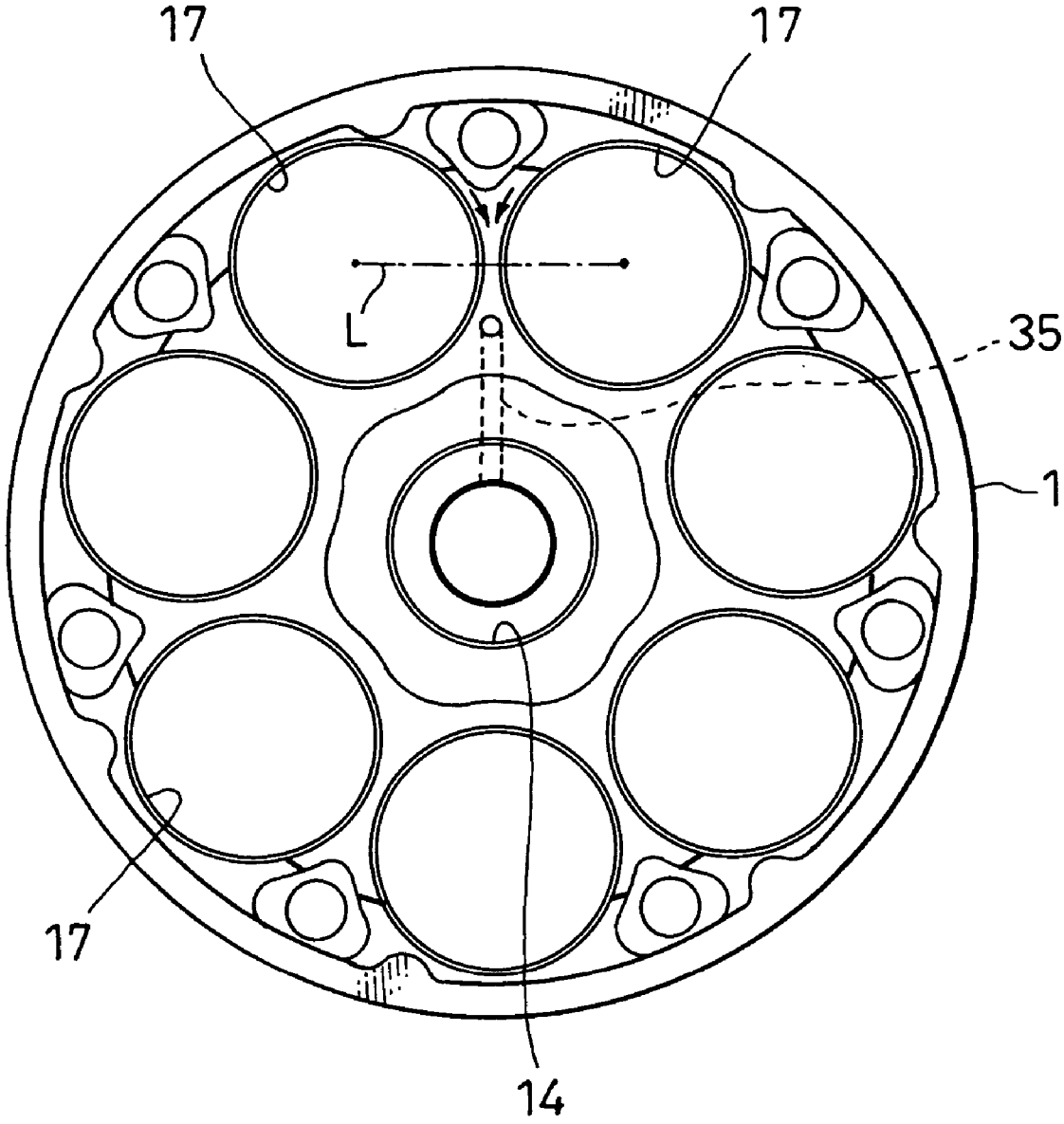
FIG. 12 shows the end surface of the cylinder block facing the crankcase with one end of the inbound oil guide passage made to open over the area further downward relative to the line (L) connecting the centers of the adjacent cylinders.

It is to be noted that while one end of the inbound oil guide passage 35 is made to open over the area where the distance between the cylinders is at the smallest at the end surface of the cylinder block facing the crankcase 4 in the structural examples described above, such an inbound oil guide passage 35 cannot be formed with ease if the piston diameter is large, the cylinders are set in close proximity to each other and there is not a sufficient area between the cylinders. Under such circumstances, one end of the inbound oil guide passage 35 may be made to open over the area on the side further downward relative to the line (L) connecting the centers of the adjacent cylinders, as shown in FIG. 12. As the figure illustrates, the oil running down the end surface of the cylinder block is first collected in the area between the cylinders, then flows downward and is readily taken into the inbound oil guide passage 35.

The alternative structure described above also achieves a marked reduction in the extent of wear, since oil is supplied in sufficient quantity through the inbound oil guide passage 35 to lubricate the plane bearing reliably.

It is to be noted that while an explanation is given above in reference to the embodiment on an example in which the present invention is adopted in a piston-type variable displacement compressor, it is obvious that the present invention may also be adopted in a fixed displacement compressor in which pistons (single-ended pistons or double-ended distance) are engaged in reciprocal sliding motion via a swashplate held at a fixed tilting angle relative to the shaft.

Furthermore, while an explanation is given above in reference to the embodiment on an example in which the bearing 16 is constituted with a plane bearing, the present invention is not limited to this example. It is obvious that the present invention may be adopted in a structure that includes a bearing 16 constituted with another type of bearing member, in a structure that does not include a bearing and the shaft 7 is rotatably supported by allowing it to directly slide against the cylinder block 1, i.e., a structure in which the shaft 7 and the cylinder block 1 are made to rotatably slide against each other without treating their surfaces, or in a structure in which the surface at least at either the shaft 7 or the cylinder block 1 is treated, the shaft 7 and the cylinder block 1 are made to rotatably slide against each other and the cylinder block 1 itself is used as a bearing.

The invention claimed is:

1. A piston-type compressor that includes a crankcase defined therein by a cylinder block having a plurality of cylinders through which pistons slide therein and a housing mounted at said cylinder block with at least a first shaft end of a shaft passing through said crankcase rotatably supported at said cylinder block via a bearing assembly or by allowing the first shaft end of said shaft to directly slide against said cylinder block and a swashplate disposed in said crankcase made to rotate as said shaft rotates thereby causing the pistons to reciprocally slide through said cylinders, wherein an inbound oil guide passage is formed within said cylinder block above the shaft and includes a first end, a second end, a first end cylindrical passage portion and a second end cylindrical passage portion, wherein the first end opens at an end surface of said cylinder block facing said crackcase between two cylinders of the plurality of cylinders that are set next to each other and wherein the second end communicates with a sliding portion inside said cylinder block from above the shaft, wherein the first end of the inbound oil guide passage opens between two adjacent cylinder bores above the shaft, below an imaginary line that is connected to the centers of the two adjacent cylinder bores, and is disposed apart from respective openings of each adjacent cylinder bore and wherein the first end cylindrical passage portion and the second end cylindrical passage portion are extended in different directions and are in fluid communication with one another internally of the cylinder block with the first end cylindrical passage portion extending from the first end to be closer to a center axis of the shaft at an angle towards the shaft and with the second end cylindrical passage portion extending from the second end either radially outwardly relative to the shaft or at an angle relative to and away from the shaft.

2. A piston-type compressor according to claim 1, wherein said bearing assembly includes a radial bearing constituted by a plane bearing and said second end of said inbound oil guide passage faces a passage connected to a sliding portion of said plane bearing.

3. A piston-type compressor according to claim 1, wherein said bearing assembly includes a radial bearing constituted by a plane bearing and said second end of said inbound oil guide passage faces a hole connecting to a sliding surface formed at said plane bearing.

4. A piston-type compressor according to claim 2, wherein said bearing assembly includes a thrust bearing and said inbound oil guide passage also communicates with said thrust bearing.

5. A piston-type compressor according to claim 3, wherein said bearing assembly includes a thrust bearing and said inbound oil guide passage also communicates with said thrust bearing.

6. A piston-type compressor according to claim 2, wherein said bearing assembly includes a thrust bearing, with said second end of said inbound oil guide passage made to open over an area between said plane bearing and said thrust bearing.

7. A piston-type compressor according to claim 1, wherein said inbound oil guide passage is formed via a closed space formed within said cylinder block.

8. A piston-type compressor according to claim 1, wherein an outbound oil guide passage through which oil having been guided through said inbound oil guide passage is guided out is formed radially outward of said sliding portion within said cylinder block.

9. A piston-type compressor according to claim 1, wherein an oil deflecting projection is formed at a lower portion of an opening at said first end of said inbound oil guide passage, which opens on said end surface of said cylinder block facing said crankcase.

10. A piston-type compressor according to claim 1, wherein said shaft rotates about a rotational axis, wherein each one of the plurality of cylinders extends along and radially about a cylinder axis which extends parallel to and is disposed radially apart from the rotational axis at a distance C, wherein the first end is disposed radially apart from the rotational axis at a distance E and wherein the distance E is less than or equal to the distance C.

11. A piston-type compressor according to claim 9, wherein said shaft rotates about a rotational axis, wherein each one of the plurality of cylinders extends along and radially about a cylinder axis which extends parallel to and is disposed radially apart from the rotational axis at a distance C, wherein the first end is disposed radially apart from the rotational axis at a distance E and wherein the distance E is less than or equal to the distance C.

* * * * *